US008056878B2

(12) United States Patent
Ramey, III

(10) Patent No.: US 8,056,878 B2
(45) Date of Patent: Nov. 15, 2011

(54) IN-LINE DOCUMENT HOLDER FOR COMPUTER WORK STATION

(75) Inventor: Thomas B. Ramey, III, Tyler, TX (US)

(73) Assignee: Vu Ryte, Inc., Tyler, TX (US)

( * ) Notice: Subject to any disclaimer, the term of this patent is extended or adjusted under 35 U.S.C. 154(b) by 237 days.

(21) Appl. No.: 12/197,205

(22) Filed: Aug. 22, 2008

(65) Prior Publication Data

US 2010/0044543 A1 Feb. 25, 2010

(51) Int. Cl.
*A47G 1/24* (2006.01)

(52) U.S. Cl. ..... 248/456; 248/453; 248/460

(58) Field of Classification Search ..... 248/441.1, 248/444.1, 447–444, 454–456, 460; D6/419
See application file for complete search history.

(56) References Cited

U.S. PATENT DOCUMENTS 3,562,796 A * 2/1971 Jacobson ..... 248/456
4,436,271 A * 3/1984 Manso ..... 248/460
4,893,775 A 1/1990 Long
5,104,086 A * 4/1992 Ramey et al. ..... 248/442.2
D376,787 S 12/1996 Calfee
5,651,524 A * 7/1997 Calfee ..... 248/442.2
5,651,525 A * 7/1997 Yang ..... 248/456
5,685,441 A 11/1997 Calfee
D390,546 S 2/1998 Calfee
5,797,578 A * 8/1998 Graffeo et al. ..... 248/453
D399,834 S 10/1998 Calfee
6,042,075 A 3/2000 Burch, Jr.
D437,600 S 2/2001 Calfee
6,435,466 B1 8/2002 Adams
D492,731 S 7/2004 Ramey, III et al.
D508,696 S 8/2005 Ramey, III et al.
7,100,883 B2 * 9/2006 Ramey et al. ..... 248/442.2

* cited by examiner

*Primary Examiner* — Gwendolyn W Baxter
(74) *Attorney, Agent, or Firm* — Dennis T. Griggs; Scott T. Griggs; Griggs Bergen LLP

(57) ABSTRACT

A document holder has compact construction for in-line placement and viewing between a keyboard and display monitor. The holder can be set-up in a minimum profile configuration to accommodate small source documents, and can be quickly expanded to accommodate relatively large source documents. Easel size conversion is provided by a compound easel that is mounted for pivotal movement on a base platform. The easel viewing angle can be tilted to suit operator viewing preferences. The document support position can be adjusted vertically up and down to provide a reading level that satisfies operator needs and preferences. The compound easel includes a "drop-down" reading rack that can be extended below the front edge of a workstation support surface in the over-hang zone adjacent the edge of the work surface and above the keyboard to allow in-line placement and use of the document holder in workstations where the available work surface area is not large enough to support a conventional document holder.

8 Claims, 7 Drawing Sheets

IN-LINE DOCUMENT HOLDER FOR COMPUTER WORK STATION

BACKGROUND OF THE INVENTION

1. Field of the Invention

This invention is related generally to document holders, and in particular to document holders that are adapted for in-line installation and use in combination with a keyboard and video display monitor in a data entry or word processing workstation.

2. Description of the Related Art

An important consideration in the use of computer workstations is the provision of ergonomically correct support for documents which are being viewed by the operator attending the workstation. Document holders have been developed which may be placed to one side of a keyboard and video display monitor. These holders require the operator to constantly look to the left or right to view documents supported by the holder while transferring information from the document to the computer or when comparing information on the document with information displayed on a display screen. Such motion can lead to eye strain and fatigue because of the repeated head and eye movements required for viewing the document, the display monitor and the keyboard.

The long hours of work spent by operators of data entry and word processing equipment underscores the need for a document holder which may be used safely and effectively, considering the physical constraints imposed by computer equipment and workstation furniture, and the personal limitations and preferences of operators who use the equipment. Preferably, the document holder should be positioned in-line between the keyboard and the display monitor, be adjustable toward or away from the operator, be capable of being tilted to improve line of sight and reduce glare or light reflection, be adjustable from side-to-side, and be vertically adjustable, both up and down.

Various types of document holders have been developed for use in conjunction with keyboard workstations. See, for example, U.S. Pat. No. 5,104,086; U.S. Pat. No. 5,651,524; and U.S. Pat. No. 7,100,883 which describe document holders having a generally vertically disposed easel which is adjustable vertically as well as laterally from side-to-side.

Other document holders have been developed which are supported for pivotal movement with respect to a support adjacent one side of a keyboard and associated machine, including a video monitor. These conventional document holders require frequent head movement and eye movement between positions for viewing a video display monitor and for viewing a document supported by the holder.

Document holders have also been developed for mounting at an elevated position above the work surface. However, such holders are generally not suitable for use where a video display monitor takes up a considerable amount of space directly behind the keyboard, for example in desk top computer workstations. Moreover, as mentioned above, conventional document holders have not provided the capability for precise positioning of the document easel over a wide range of viewing positions. That capability is desirable for an ergonomically correct workstation where a source document is being viewed by a keyboard operator who also requires constant reference to the video display screen. Such a range of positions should provide for correctly placing the source document to minimize head and eye movement of the operator, and more importantly, accommodate the needs of individual operators who have different physical limitations and personal viewing preferences.

BRIEF SUMMARY OF THE INVENTION

Currently, modern display monitors and computing equipment are undergoing substantial size reductions, and have relatively small "footprint" support surface requirements. Likewise, the equipment support surface area provided by modern workstation furniture is undergoing a corresponding size reduction. In these modern workstations, the support surface area provided between a data entry keyboard and video display monitor is substantially limited as compared to that provided by older workstations. The document holder of the present invention utilizes that limited surface support area more efficiently and advantageously by a compact holder construction which can be set-up in a minimum profile configuration to accommodate small source documents, and can be quickly expanded to accommodate relatively large source documents.

According to one aspect of the invention, easel size conversion capability is provided by a compound easel that is mounted for pivotal movement on a base platform. The support profile of the compound easel can be adjusted to accommodate source documents of different sizes, and the viewing angle can be tilted to satisfy operator preference. Moreover, the compound easel can be adjusted vertically up and down to provide document support at a reading level that satisfies operator needs and preferences. Further, the compound easel includes a "drop-down" reading rack that can be extended below the edge of a workstation support surface to allow in-line placement and use of the document holder in workstations where the available work surface area between the keyboard and the display monitor is not large enough to support a conventional document holder.

Because of its compact profile, the document holder of the present invention is well-adapted for in-line placement and viewing between a keyboard and display monitor. Because of its easel size adjustability, source documents of different sizes may be brought into a more suitable viewing range. Moreover, the limited work surface area between the keyboard and the display monitor may be better utilized without obscuring the operator's view of the display screen and without encroaching the keyboard space. In some workstations, the keyboard is supported on a pull-out tray below the edge of the work surface. In those workstations, the drop-down reading rack feature of the present invention efficiently utilizes the available vertical space by supporting the source document in a preferred, ergonomically correct position in the over-hang zone adjacent the edge of the work surface and above the keyboard.

The present invention therefore provides a versatile document holder that is particularly well adapted for in-line installation and document viewing in combination with a video display monitor and keyboard of a computer workstation. The vertical position, inclination, and document support profile of the holder are adjustable to accommodate large as well as source documents, the physical limitations imposed by workstation equipment, and the personal needs and preferences of individual operators.

DETAILED DESCRIPTION OF THE INVENTION

Figure 1:
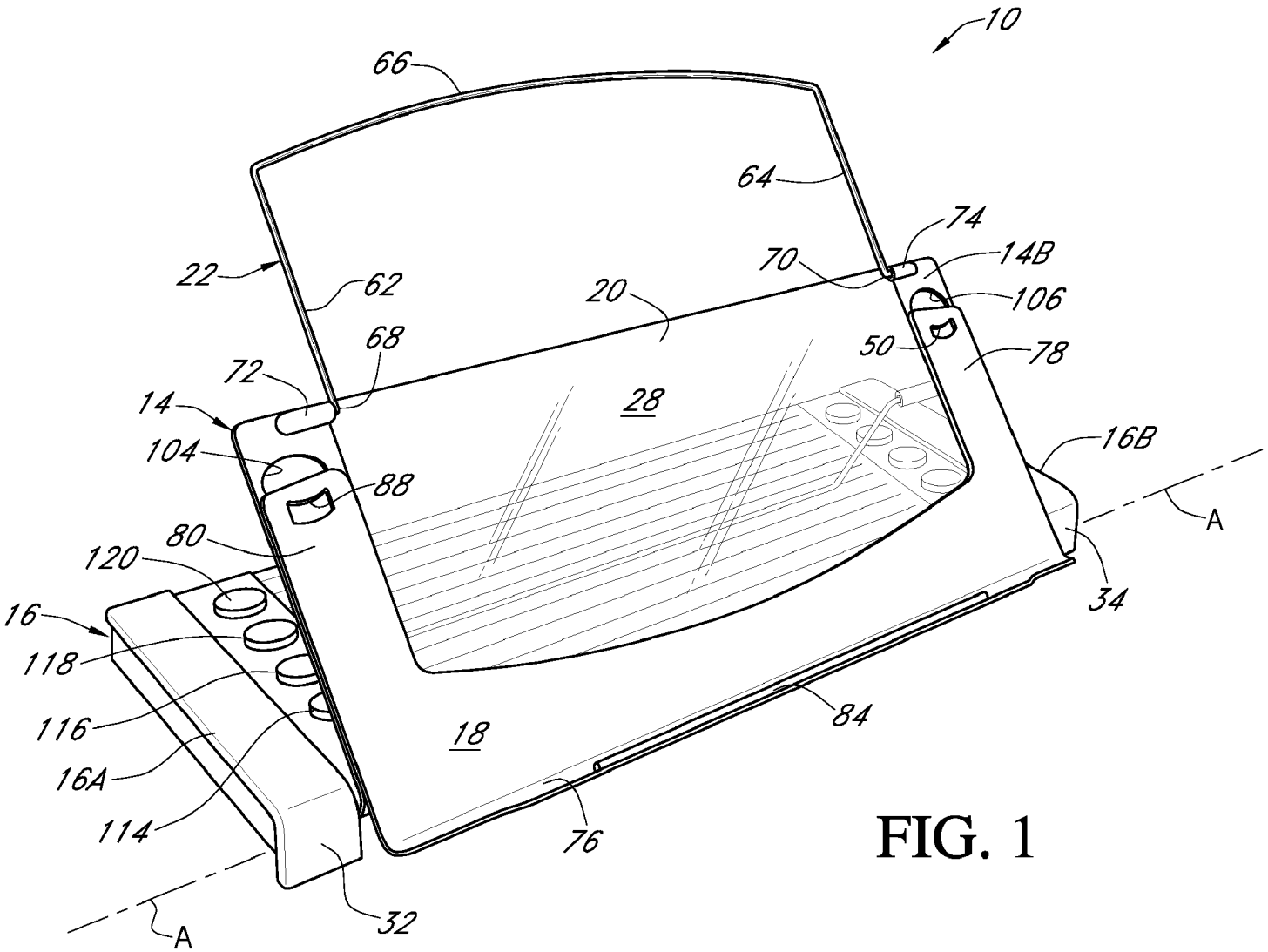
FIG. 1 is a front perspective view of the document holder of the present invention, showing its compound easel and document support bracket set up in its extended profile, large document support position.

In the description which follows, like parts are marked throughout the specification and drawing with the same reference numerals, respectively. The drawing figures are not necessarily drawn to scale.

Referring now to FIG. 1, the document holder 10 is shown set up in an operative position for in-line use in conjunction with a conventional desktop computer workstation of the type having a video display monitor positioned in a generally vertical or near vertical reading plane on a desk top 12 or other horizontal work surface of a work station, which may be, for example, a computer cabinet, side table, data entry terminal or desk. The document holder 10 is particularly useful for in-line placement in workstations in which a conventional keyboard rests on a work surface directly in front of a video display monitor so that an operator who uses the keyboard may easily view a source document and the monitor while transferring data from the source document to the computer. Optionally, the operator may compare source document data with data being displayed on the monitor.

Many operations involving the use of a computer workstation, such as described above, require the transfer of information via a keyboard from a source document to a computer or a similar machine, or the comparison of information on the source document with information displayed on the screen of a video display monitor, or the editing of information displayed on the screen via a keyboard, using the source document as a reference. Consequently, in-line document support provides considerable benefits in such workstation operations.

Figure 2:
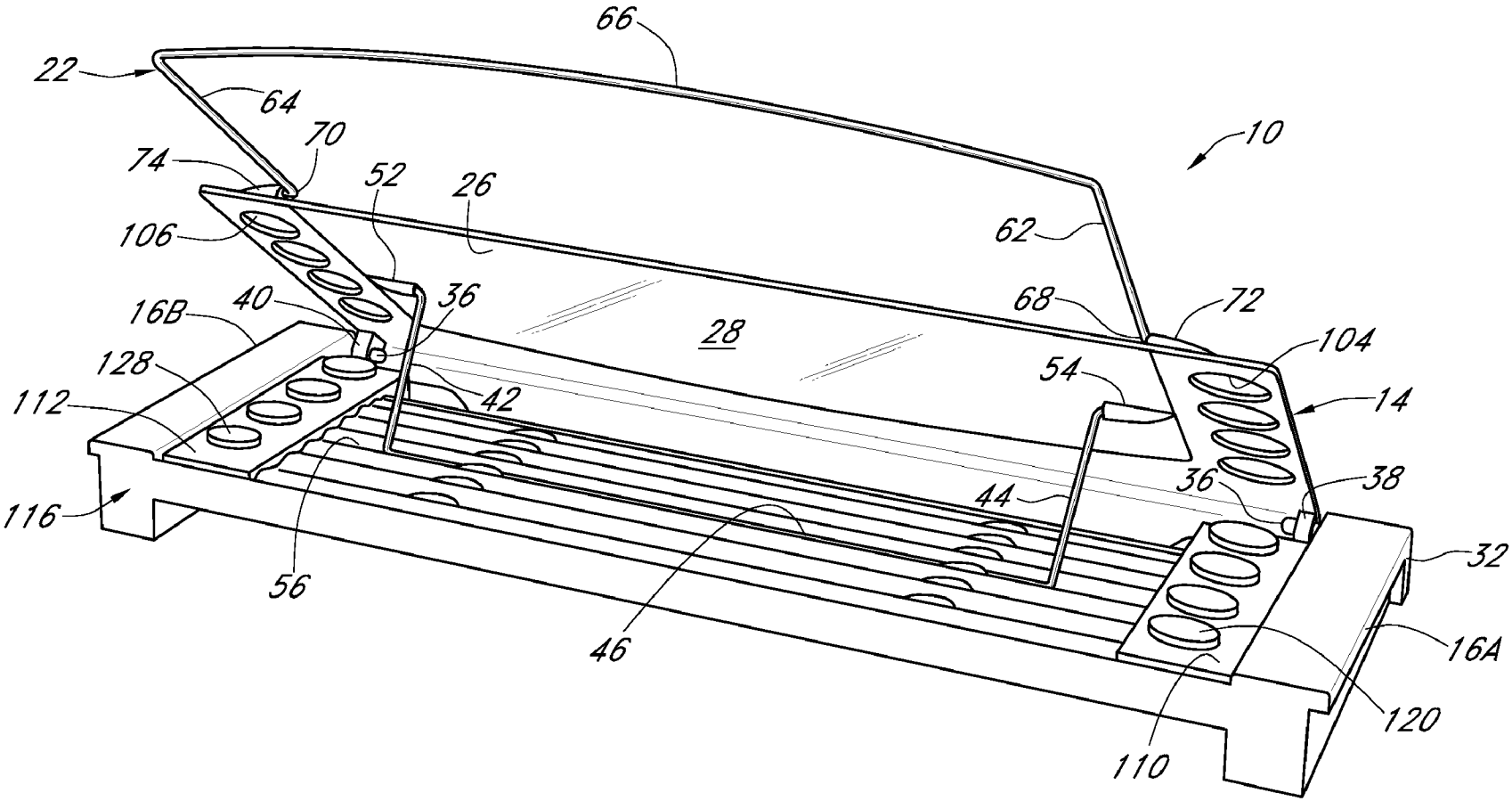
FIG. 2 is a rear perspective view thereof.
Figure 3:
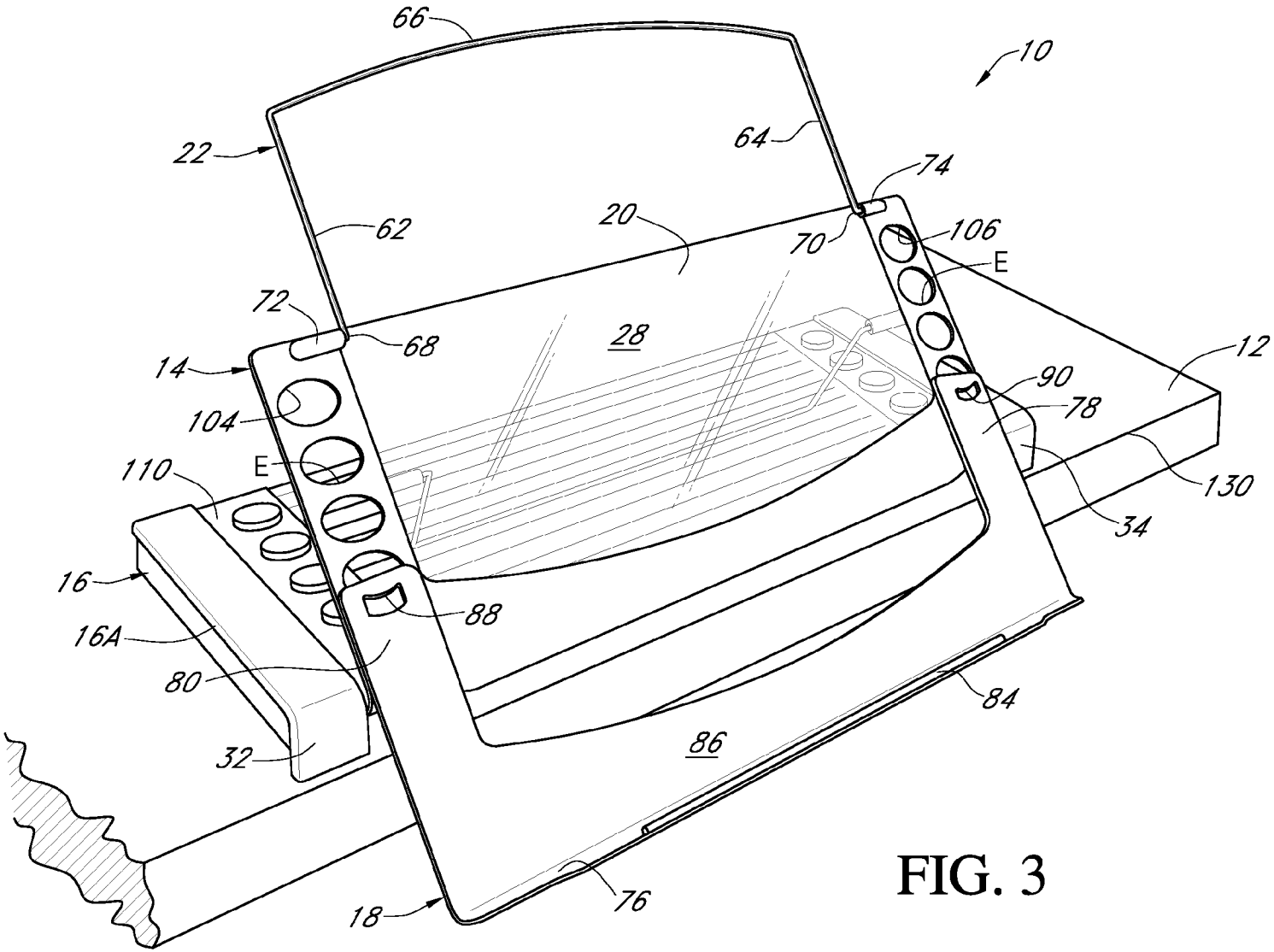
FIG. 3 is front perspective view of the document holder of FIG. 1, showing its compound easel and reading rack set up in its drop-down document support position.

Referring now to FIG. 1 and FIG. 2, the principal components of the document holder 10 include a compound easel 14 and a base platform 16 on which the easel is movably mounted for pivotal opening and closing movement. The compound easel 14 includes a first easel member in the form of a flat panel 28 and a second easel member in the form of a reading rack 18, which is removably attached in overlapping relation onto the forward face 20 of the panel 28, and an easel extension bracket 22, which is coupled to the easel for movement from a closed position overlapping the forward face 20 of the easel, to an extended position above the easel for supporting an over-sized document. The base platform 16 is adapted for level placement on the work surface 12 as shown in FIG. 3. The easel 14 is coupled to the base platform for pivotal movement about a lateral axis A from a first inclined viewing plane position to a second inclined viewing plane position, according to operator preference. The compound easel 14 is supported in a user-selected viewing angle by a prop bracket 24.

Figure 4:
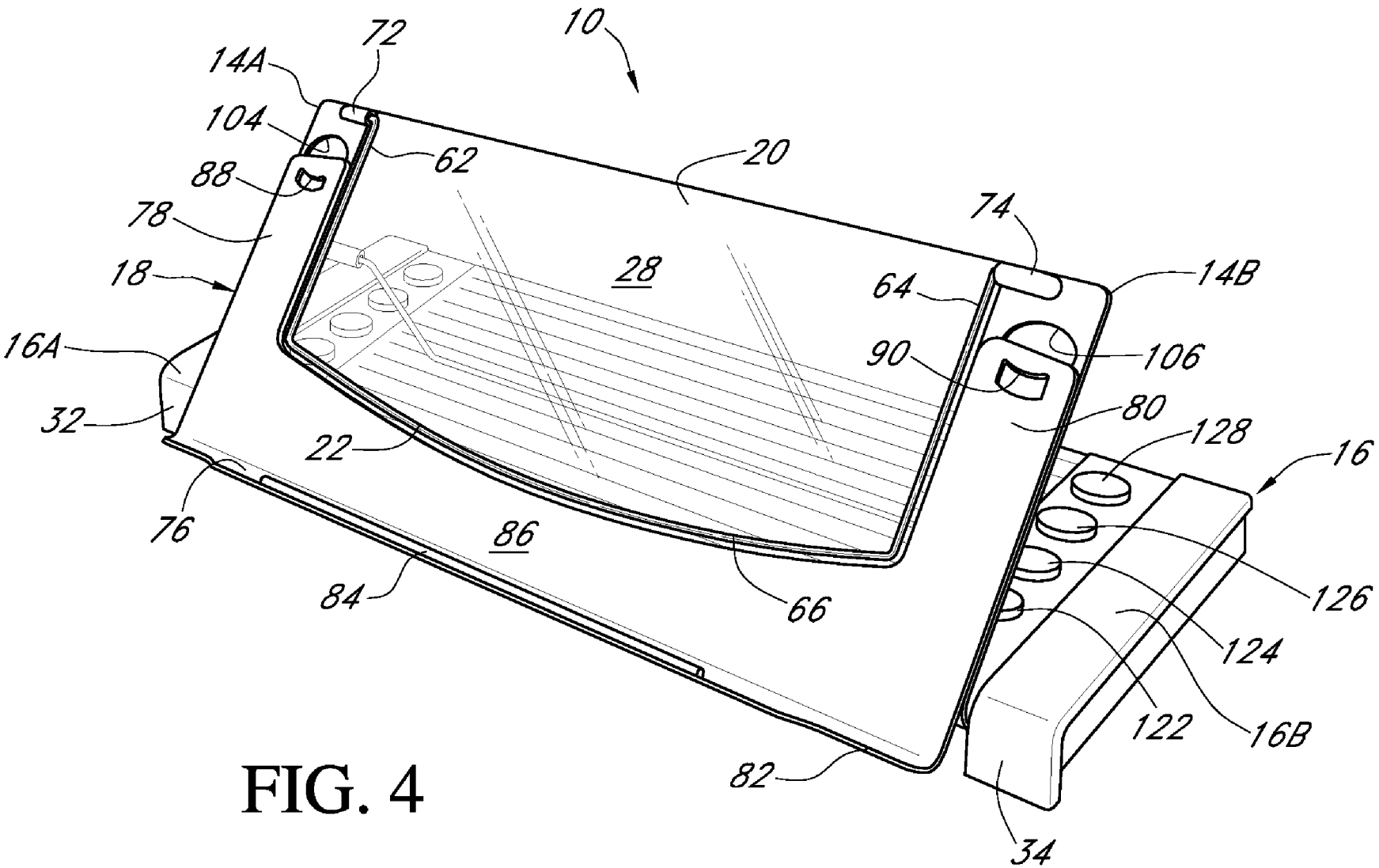
FIG. 4 is a front perspective of the document holder of FIG. 1, showing set up in its minimum profile, small document support position.

The prop bracket 24 is movably coupled to the rear face 26 of the easel and is releasably attached to the base platform 16 for adjusting and setting the viewing plane angle of the easel according to operator preference. The reading rack 18 includes a document support flange 76 and hook means 88, 90 for selectively attaching the reading rack onto the easel at a first easel location 104, 106 wherein the document support flange is maintained at a first elevation relative to the base platform 16, for example above the work surface 12 as shown in FIG. 4, and at a second location wherein the document support flange 76 is maintained at a second elevation relative to the base platform, for example below the work surface edge 130, as shown in FIG. 3.

Figure 8:
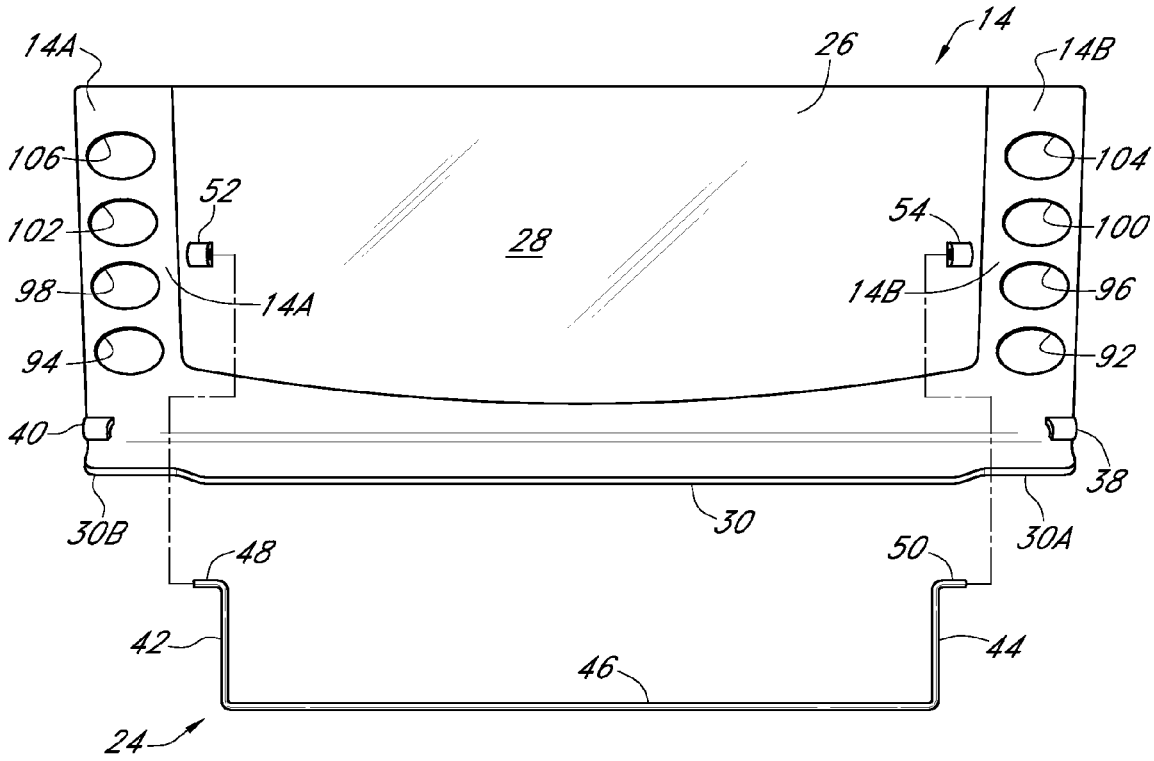
FIG. 8 a rear elevation view of the compound easel and prop bracket.

Referring now to FIG. 1, FIG. 2 and FIG. 8, the compound easel 14 is formed of a durable plastic material, and preferably includes a transparent viewing window pane portion 28. The window pane portion has a surface formed on the forward face 20 which provides an erasable writing surface. Preferably, the writing surface is compatible with dry erase markers of the kind that are used for writing on dry-erase white boards.

Figure 5:
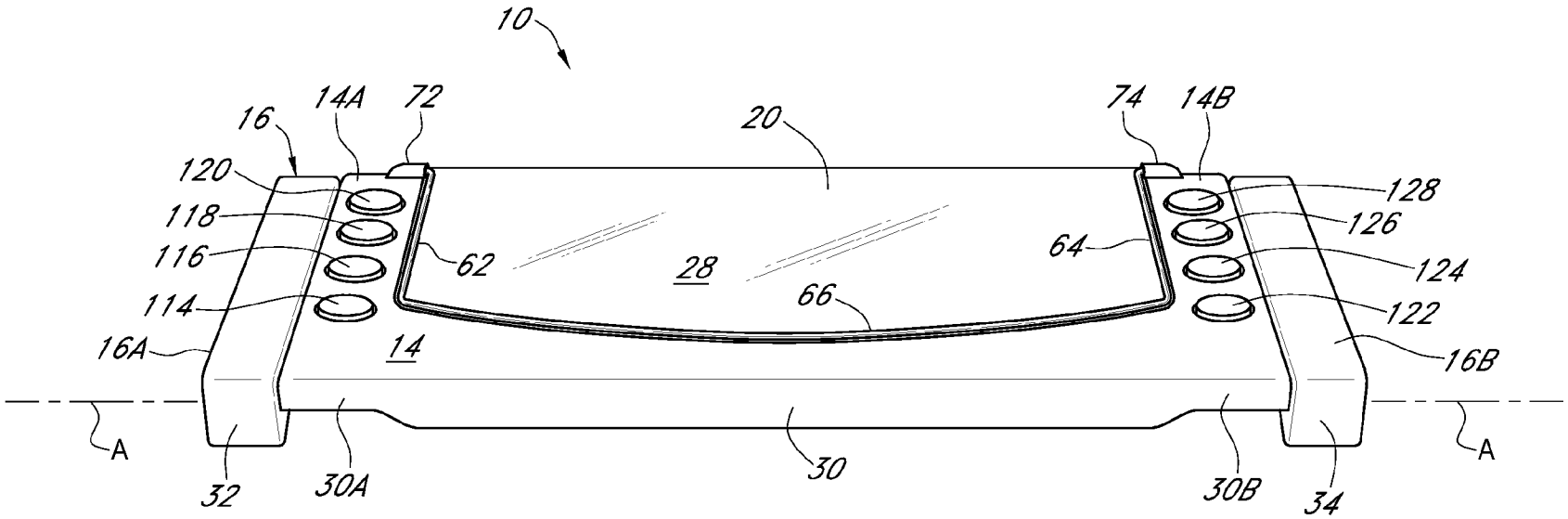
FIG. 5 is a front perspective of the document holder of FIG. 1, showing its compound easel and reading rack set up in its fully collapsed, storage position.
Figure 9:
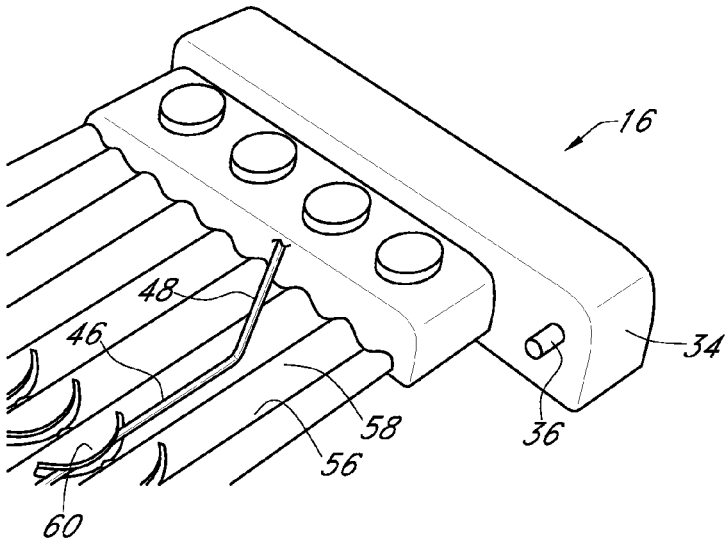
FIG. 9 is a front perspective view of the base platform, partially broken away, and with the easel removed.

The easel 14 also includes an inwardly-turned, lower coupling flange 30 that extends along the width dimension of the easel between hinge portions 32, 34 formed on laterally opposite side portions 16A, 16B of the base platform 16. Hinge pins 36 are formed on the hinge portions 32, 34, as shown in FIG. 2 and FIG. 9. The hinge pins are received in a pair of hinge pockets 38, 40 that are formed on opposite end portions 30A, 30B of the coupling flange 30, as shown in FIG. 8. This hinge construction allows the easel 14 to rotate from a fully collapsed, minimum profile position as shown in FIG. 5, to an upright reading position as shown in FIG. 1. The pin and socket coupling arrangement ensures that the easel 14 will remain securely engaged with the hinge pins 36 during use.

Referring now to FIG. 2, FIG. 8 and FIG. 9, the viewing angle of the easel 14 is adjusted and set according to operator preference by the prop bracket 24. In the preferred embodiment, the prop bracket 24 is formed by bending a length of nickel plated stainless steel wire, having a diameter of about 0.080 inch (about 2 mm, AWG 12 gauge) into the profile shown in FIG. 9. The prop bracket 24 includes a pair of strut segments 42, 44 that are integrally formed with opposite end portions of a central latch segment 46. The prop bracket 24 also includes integrally formed hinge pin segments 48, 50 that project laterally from the struts 42, 44, respectively.

The hinge pin segments 48, 50 are received in hinge pockets 52, 54, respectively, that are formed on sidebar potions 14A, 14B of the easel 14. The strut segments 42, 44 are manually deflected slightly to permit insertion of the coupling pins 48, 50 into the pockets, as indicated in FIG. 8. When the strut segments are released, the prop bracket 24 applies a resilient bias force which maintains pin engagement while allowing pivotal rotation of the prop bracket 24 relative to the easel 14.

Referring to FIG. 2 and FIG. 8, the central latch segment 46 of the prop bracket 24 may be inserted into any one of multiple grooves 56 that are formed in the base platform 16. The grooves 56 extend longitudinally in parallel alignment, and are equally spaced apart by projecting ridge portions 58. In the preferred embodiment, the grooves 56 are spaced apart on 0.50 inch centers. This spacing provides adjustment in 5 degree slope increments of the easel viewing plane through a range of from about 27 degrees to about 52 degrees relative to the support plane of the base platform 16. The central latch segment 46 of the prop bracket 24 is retained in an operator-selected groove 56 by snap-fit detent engagement within a latching pocket provided by a tab 60. The tab 60 is integrally formed with the projecting ridge 58, and yields and deflects slightly as the latch segment 46 is inserted into the groove 56. Upon complete insertion, the tab 60 returns to its unloaded position, thus maintaining the latch segment 46 in the selected groove 56.

The document support extension bracket 22 can be rotated between the fully extended position shown in FIG. 1 to the minimum profile, fully retracted position shown in FIG. 4. An enlarged easel profile for full support of an over-size document may be selected and set by the operator, for example, when a large source document is to be viewed. The terms "large" and "over-size" in this example should be considered with reference to the support area provided by the document holder 10 when set-up in its maximum profile configuration as shown in FIG. 1, as compared to its minimum profile configuration as shown in FIG. 4.

The minimum profile configuration is intended for use with cards and other small source documents that are smaller than standard 8½×11 inch letter-size documents. When it is desired to support an oversize source document, the extension bracket 22 is rotated to the full up position as shown in FIG. 3, and is retained in that position by positive stop contact engagement of the extension bracket against the underlying forward face 20 of the easel 14.

The construction of the upper extension bracket 22 is similar to the construction of the prop bracket 24. The extension bracket 22 is formed by bending a length of nickel plated stainless steel wire having a diameter of about 0.080 inch (about 2 mm), into the profile shown in FIG. 3. The extension bracket 22 includes a pair of extension arms 62, 64 that are integrally formed with opposite end portions of a central bail segment 66. The extension bracket 22 also includes integrally formed hinge pin segments 68, 70 that project laterally from the extension arms 62, 64, respectively. The pin segments 68, 70 are received in hinge coupling pockets 72, 74, respectively, that are formed on the sidebar potions 14A, 14B of the easel 14.

The extension arms 62, 64 are manually deflected slightly to permit insertion of the coupling pins into the sidebar hinge pockets 72, 74. When the extension arms 52, 64 are released, the extension bracket 22 applies a resilient bias force which maintains pin engagement while allowing pivotal rotation of the extension bracket 22 relative to the easel 14. Pivoting movement of the extension bracket 22 is limited by positive stop engagement of the extension arms 62, 64 against the underlying forward face 20 of the easel 14.

Referring now to FIG. 1, FIG. 3, FIG. 4 and FIG. 6, the reading rack 18 is removably attached in overlapping relation onto the forward face 20 of the easel 14. The primary function of the reading rack 18 is to provide subjacent support for a source document. For this purpose, the reading rack 18 includes a document support flange 76 that overlaps and extends along the width dimension of the easel 14. The support flange 76 is integrally formed with and extends between laterally opposite sidebar portions 78, 80. The support flange 76 includes a web portion 82 that projects outboard relative to the sidebar portions. A lip 84 is formed along the outboard edge of the flange for retaining one or more source documents. The support flange 76 is reinforced by an elongated web portion 86 that is integrally formed with the sidebar portions 78, 80 and the web portion 84.

Figure 6:
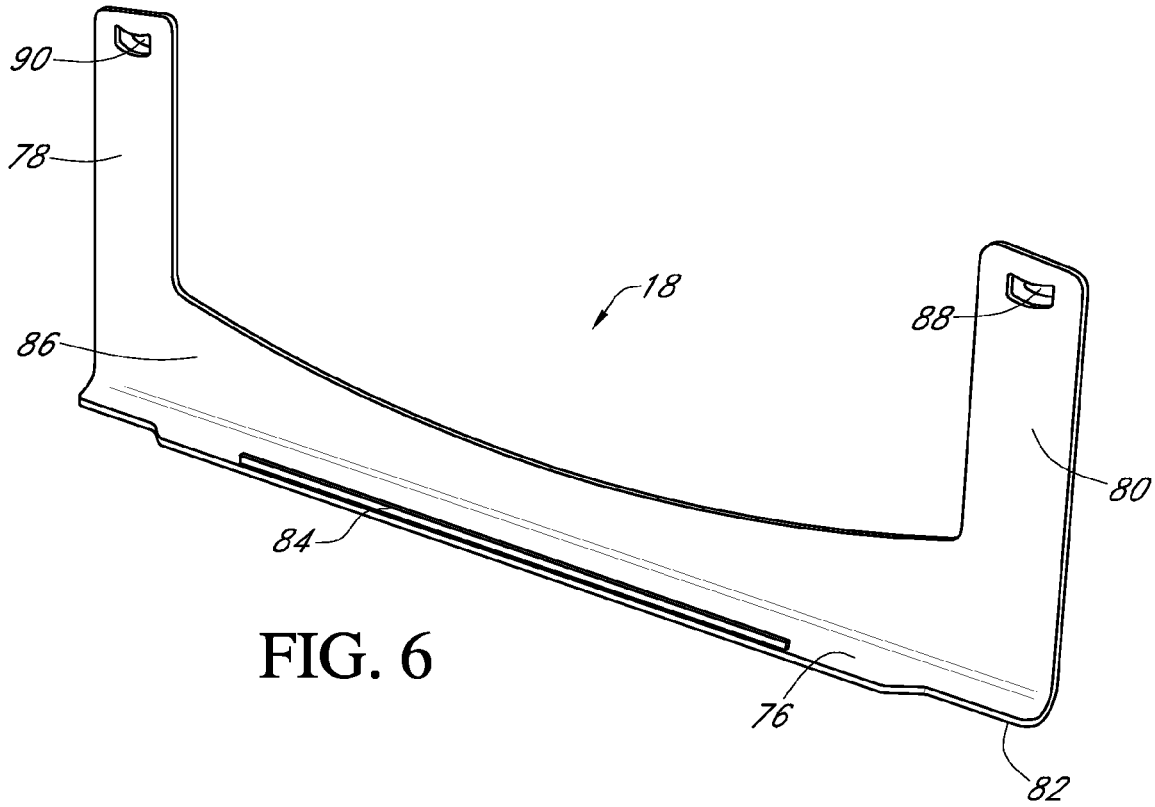
FIG. 6 is a front perspective view of the reading rack.
Figure 7:
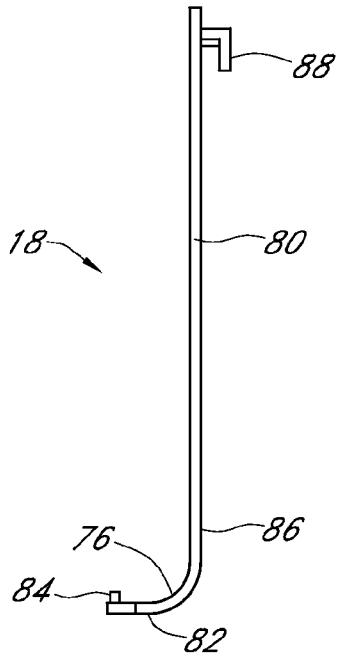
FIG. 7 is a right side elevation view of the reading rack.

According to an important feature of the invention, the reading rack 18 is movably coupled to the easel 14 for adjustable placement in overlapping engagement with the front face 20 of the easel at spaced locations along the easel sidebar portions 14A, 14B, as shown in FIG. 1. For this purpose, the reading rack 18 is provided with a pair of retainer hooks 88, 90 that are formed on the rear faces of the sidebar portions 78, 80, as shown in FIG. 6 and FIG. 7. The retainer hooks 88, 90 are dimensioned for interlocking engagement with the easel sidebar portions at the predetermined vertical locations provided by the pairs of index apertures 92, 94; 96, 98; 100, 102; and 104, 106 that are formed in the easel sidebar portions 14A, 14B, respectively.

The reading rack 18 is mounted at an operator-selected vertical position on the front face 20 of the easel 14 by inserting the retainer hooks 88, 90 into a selected pair of index apertures and then pulling the reading rack downwardly along the face of the easel until the retainer hooks are brought into positive stop engagement against the lower edge portions E which delimit the index apertures. The reading rack 18 can be removed and placed in another vertical location by manually pushing the reading rack up until the retainer hooks 88, 90 disengage from the easel sidebar portions, and then repeating the installation steps in a new vertical location selected by the operator.

In the preferred embodiment, the index apertures are disposed in vertical alignment with each other along each sidebar, and the index apertures in each sidebar are disposed in horizontal alignment with the corresponding apertures of the other sidebar. Preferably, for ease of installation and removal of the reading rack 18, the index apertures are elliptical in profile.

Referring now to FIG. 5, the document holder 10 is shown in its fully collapsed, storage configuration. In this configuration, the reading rack is removed from the easel 14 and placed in nesting engagement within a storage pocket 108 formed along the underside of the base platform 16. The prop bracket 24 is released from detent engagement with the tab 60 and folded against the rear face 26 of the easel. The extension bracket 22 is folded over onto the front face 20 of the easel 14. The easel 14 is then folded back onto the base platform 16 and is received in flush engagement between the left and right base sidebar portions 16A, 16B.

The easel sidebar portions 14A, 14B engage against left and right platform blocks 110, 112 in the fully collapsed, storage configuration. The easel 14 is secured into the minimum profile storage position by a first set of index stubs 114, 116, 118 and 120 that are integrally formed with the left platform block (unnumberd) and by engagement of a second set of index stubs 122, 124, 126 and 128 that are integrally formed with the right platform block 112 (see FIG. 9). The first set of index stubs are engagable in the first array of index apertures 94, 98, 102 and 106, and the second set of index stubs are engagable in the second array of index apertures 92, 96, 100 and 104 (See FIG. 8).

According to another important feature of the invention, the compound easel 14 may be adjusted to provide document support over a wide range of vertical reading positions, both up and down, with respect to the base platform 16 to optimize the location of source documents to accommodate workstation constraints and operator preferences. This vertical adjustability feature is provided by the "drop-down" reading rack 18 that can be extended below the edge 130 of a workstation support surface 12 to allow in-line placement and use of the document holder in workstations where the available work surface area between the keyboard and the display monitor is not large enough to support a conventional document holder.

Referring again to FIG. 3, the document support flange 76 of the reading rack 18 is extended below the front edge 128 of the work surface 12. The reading rack is secured in the drop-down position by engagement of the retainer hooks 88, 90 in the lower index apertures 90, 92. The document support flange 76 of the reading rack 18 adjusts over a range of approximately 6 inches relative to the rotational axis A of the easel. In the preferred embodiment, vertical ad adjustment of the reading rack and document support flange 76 relative to the easel 14 is performed in 2-inch increments.

The easel extension bracket 22 may be moved to the extended position as shown in FIG. 3 to provide in-line support for a large source document (e.g., 8½×11 inches standard letter size) while the reading rack is in the drop-down position. Optionally, or the easel extension bracket may be retracted to provide in-line support for a small source document, while the reading rack is set in the drop-down position.

Preferably, the base platform 16, the coupling flange 30 and sidebar portions 14A, 14B of the easel 14, and the document support flange 76 and sidebar portions 78, 80 of the reading rack 18 are constructed of high impact polystyrene resin. The transparent pane 28 of the easel is formed of clear acrylic resin. All panel sidewalls of the document holder components have a nominal thickness of 0.075 inch (about 2 mm). All components are fabricated by conventional injection molding equipment and methods.

The invention has been particularly shown and described with reference to a preferred embodiment in which examples have been given to explain what I believe is the best way to make and use my document holder invention. The materials, components and dimensional values given in the detailed description are exemplary of those that may be used in the successful practice of my invention.

I claim:

1. A document holder comprising, in combination:

a base platform adapted for placement on a work surface of a computer workstation;

a compound easel mounted for pivotal movement on the base platform, the compound easel including a first easel member having a planar document support surface delimited by a lower edge and an upper edge, and a second easel member movably coupled to the first easel member, the second easel member having a document support surface and a document support flange, the second easel member being releasably attached to the first easel member by cooperating fastener portions for supporting the second easel member in a selected one of a plurality of working positions relative to the lower edge of the first easel member, the second easel member being movable in a direction generally toward and away from the lower edge of the first easel member to provide for supporting a document in a selected viewing position relative to the base platform;

the first easel member and the second easel member include cooperating support portions for locating the second easel member on the first easel member in at least one selected working position in which the document support flange is supported below the elevation of the work surface; and an extension bracket supported on the first easel member adjacent the upper edge of the first easel member and operable to be moved to a selected working position in a direction opposite a position of the second easel member to aid in supporting a document on the easel, the selected working position of the extension bracket determining the angle between the first easel member and the base platform.

2. The document holder set forth in claim 1 wherein:

the first easel member includes a viewing panel formed on the forward face thereof which provides an erasable writing surface.

3. A document holder adapted for in-line placement on a work surface between a keyboard and a display monitor in a computer workstation, comprising in combination:

a base platform;

a compound easel including a first easel member and a second easel member, the first easel member being mounted for pivotal movement on the base platform, the second easel member including a document support flange and being disposed on the first easel member for extension and retraction movement relative to the first easel member;

first cooperative support portions disposed on the easel members for holding the second easel member on the first easel member in at least one selected working position in which the document support flange is supported below the elevation of the work surface;

second cooperative support portions disposed on the easel members for holding the second easel member on the first easel member in at least one selected working position in which the document support flange is supported above the elevation of the work surface; and an extension bracket supported on the first easel member adjacent an upper edge of the first easel member and operable to be moved to a selected working position in a direction opposite a position of the second easel member to aid in supporting a document on the easel, the selected working position of the extension bracket determining the angle between the first easel member and the base platform.

4. A document holder comprising, in combination:

a base platform adapted for placement on a work surface of a computer workstation;

a compound easel mounted for pivotal movement on the base platform, the compound easel including a first easel member having a planar document support surface delimited by a lower edge and an upper edge, and a second easel member movably coupled to the first easel member, the second easel member having a document support surface and a document support flange, the second easel member being releasably attached to the first easel member by cooperating fastener portions for supporting the second easel member in a selected one of a plurality of working positions relative to the lower edge of the first easel member, the second easel member being movable in a direction generally toward and away from the lower edge of the first easel member to provide for supporting a document in a selected viewing position relative to the base platform;

the first easel member and the second easel member include cooperating support parts for locating the second easel member on the first easel member in at least one selected working position in which the document support flange is supported above the base platform; and an extension bracket supported on the first easel member adjacent the upper edge of the first easel member and operable to be moved to a selected working position in a direction opposite a position of the second easel member to aid in supporting a document on the easel, the selected working position of the extension bracket determining the angle between the first easel member and the base platform.

5. A document holder comprising, in combination:

a base platform adapted for placement on a work surface of a computer workstation;

a compound easel mounted for pivotal movement on the base platform, the compound easel including a first easel member having a planar document support surface delimited by a lower edge and an upper edge, and a second easel member movably coupled to the first easel member, the second easel member having a document support surface and a document support flange, the second easel member being releasably attached to the first easel member by cooperating fastener portions for supporting the second easel member in a selected one of a plurality of working positions relative to the lower edge of the first easel member, the second easel member being movable in a direction generally toward and away from the lower edge of the first easel member to provide for supporting a document in a selected viewing position relative to the base platform;

the first easel member and the second easel member include cooperating support parts for locating the second easel member on the first easel member in at least one selected working position in which the document support flange is supported approximately even with the elevation of the work surface; and an extension bracket supported on the first easel member adjacent the upper edge of the first easel member and operable to be moved to a selected working position in a direction opposite a position of the second easel member to aid in supporting a document on the easel, the selected working position of the extension bracket determining the angle between the first easel member and the base platform.

6. A document holder comprising, in combination:

a base platform adapted for placement on a work surface of a computer workstation;

a compound easel mounted for pivotal movement on the base platform, the compound easel including a first easel member having a planar document support surface delimited by a lower edge and an upper edge, and a second easel member movably coupled to the first easel member, the second easel member having a document support surface and a document support flange, the second easel member being releasably attached to the first easel member by cooperating fastener portions for supporting the second easel member in a selected one of a plurality of working positions relative to the lower edge of the first easel member, the second easel member being movable in a direction generally toward and away from the lower edge of the first easel member to provide for supporting a document in a selected viewing position relative to the base platform;

the first easel member includes laterally spaced sidebar members that are intersected by coupling apertures, and the second easel member includes laterally spaced sidebar members and coupling retainers attached thereto, wherein the coupling retainers are engagable with the first easel member through the coupling apertures for holding the second easel member at a selected one of two or more separate locations on the first easel member in which a source document is maintained in two or more viewing positions; and an extension bracket supported on the first easel member adjacent the upper edge of the first easel member and operable to be moved to a selected working position in a direction opposite a position of the second easel member to aid in supporting a document on the easel, the selected working position of the extension bracket determining the angle between the first easel member and the base platform.

7. A document holder comprising, in combination:

a base platform adapted for placement on a work surface of a computer workstation;

a compound easel mounted for pivotal movement on the base platform, the compound easel including a first easel member having a planar document support surface delimited by a lower edge and an upper edge, and a second easel member movably coupled to the first easel member, the second easel member having a document support surface and a document support flange, the second easel member being releasably attached to the first easel member by cooperating fastener portions for supporting the second easel member in a selected one of a plurality of working positions relative to the lower edge of the first easel member, the second easel member being movable in a direction generally toward and away from the lower edge of the first easel member to provide for supporting a document in a selected viewing position relative to the base platform; and an extension bracket supported on the first easel member adjacent the upper edge of the first easel member and operable to be moved to a selected working position in a direction opposite a position of the second easel member to aid in supporting a document on the easel, the selected working position of the extension bracket determining the angle between the first easel member and the base platform.

8. The document holder set forth in claim 7 wherein:

the first easel member includes a cooperating stop portion for limiting movement of the extension bracket relative to the first easel member.

* * * * *